US008298352B2

(12) United States Patent
Brunner

(10) Patent No.: US 8,298,352 B2
(45) Date of Patent: Oct. 30, 2012

(54) METHOD FOR THE PRODUCTION OF MAGNET CORES, MAGNET CORE AND INDUCTIVE COMPONENT WITH A MAGNET CORE

(75) Inventor: Markus Brunner, Bessenbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 327 days.

(21) Appl. No.: 12/670,119

(22) PCT Filed: Jul. 23, 2008

(86) PCT No.: PCT/IB2008/052948

§ 371 (c)(1),
(2), (4) Date: Jan. 21, 2010

(87) PCT Pub. No.: WO2009/013711

PCT Pub. Date: Jan. 29, 2009

(65) Prior Publication Data

US 2010/0194507 A1 Aug. 5, 2010

(30) Foreign Application Priority Data

Jul. 24, 2007 (DE) ..... 10 2007 034 925

(51) Int. Cl.
*H01F 1/153* (2006.01)
*H01F 1/147* (2006.01)
*H01F 1/28* (2006.01)

(52) U.S. Cl. ..... 148/304; 148/306; 148/310; 148/311; 148/312; 148/313

(58) Field of Classification Search ..... None
See application file for complete search history.

(56) References Cited

U.S. PATENT DOCUMENTS

| | | | |
|---|---|---|---|
| 3,255,512 | A | 6/1966 | Lochner et al. |
| 4,059,462 | A | 11/1977 | Masumoto et al. |
| 4,076,861 | A | 2/1978 | Furukawa et al. |
| 4,201,837 | A | 5/1980 | Lupinski |
| 4,305,056 | A | 12/1981 | Mochida et al. |
| 4,472,334 | A | 9/1984 | Gallimard |
| 4,543,208 | A | 9/1985 | Horie et al. |

(Continued)

FOREIGN PATENT DOCUMENTS

DE 502063 7/1930

(Continued)

OTHER PUBLICATIONS

E. Wolfarth: "Ferromagnetic Materials vol. 2,"—Soft Magnetic Metallic Materials—p. 73 (1980).

(Continued)

*Primary Examiner* — John Sheehan
(74) *Attorney, Agent, or Firm* — Buchanan Ingersoll & Rooney PC

(57) ABSTRACT

A magnet core (1) made of a composite of platelet-shaped particles of a thickness D and a binder has a particularly linear relative permeability curve over a pre-magnetised constant field. For this purpose, the platelet-shaped particles (5) are provided with an amorphous volume matrix (8), wherein areas (9) with a crystalline structure having a thickness d of $0.04*D \leqq d \leqq 0.25*D$ and covering a proportion x of $x \geqq 0.1$ of the surface (6, 7) of the particle (5) are embedded on the surface (6, 7) of the particle (5).

15 Claims, 3 Drawing Sheets

U.S. PATENT DOCUMENTS

| | | | | |
|---|---|---|---|---|
| 4,601,765 | A | 7/1986 | Soileau et al. | |
| 4,743,311 | A | 5/1988 | Schultz et al. | |
| 4,812,181 | A | 3/1989 | Hilzinger et al. | |
| 4,923,533 | A | 5/1990 | Shigeta et al. | |
| 4,985,089 | A | 1/1991 | Yoshizawa et al. | |
| 5,038,460 | A | 8/1991 | Ide et al. | |
| 5,144,745 | A | 9/1992 | Yoshimura et al. | |
| 5,160,379 | A | 11/1992 | Yoshizawa et al. | |
| 5,252,148 | A | 10/1993 | Shigeta et al. | |
| 5,331,730 | A | 7/1994 | Brinn, Jr. | |
| 5,449,419 | A | 9/1995 | Suzuki et al. | |
| 5,509,975 | A | 4/1996 | Kojima et al. | |
| 5,522,948 | A | 6/1996 | Sawa et al. | |
| 5,594,397 | A | 1/1997 | Uchikoba et al. | |
| 5,751,207 | A | 5/1998 | Poess | |
| 5,762,967 | A | 6/1998 | Sagawa et al. | |
| 5,871,681 | A | 2/1999 | Karino et al. | |
| 5,973,424 | A | 10/1999 | Engelberger et al. | |
| 6,001,272 | A | 12/1999 | Ikuma et al. | |
| 6,028,353 | A | 2/2000 | Nakano et al. | |
| 6,038,760 | A | 3/2000 | Antoine et al. | |
| 6,103,157 | A | 8/2000 | Behm et al. | |
| 6,106,376 | A | 8/2000 | Rybak et al. | |
| 6,189,204 | B1 | 2/2001 | Shikama et al. | |
| 6,373,368 | B1 | 4/2002 | Shikama et al. | |
| 6,392,525 | B1 | 5/2002 | Kato et al. | |
| 6,478,889 | B2 | 11/2002 | Kanekiyo et al. | |
| 6,663,815 | B1 | 12/2003 | Hundt et al. | |
| 6,682,681 | B1 | 1/2004 | Clark et al. | |
| 6,685,882 | B2 | 2/2004 | Deevi et al. | |
| 6,710,692 | B2 | 3/2004 | Kato et al. | |
| 6,749,767 | B2 | 6/2004 | Mitani et al. | |
| 6,750,723 | B2 | 6/2004 | Yoshida et al. | |
| 6,814,776 | B2 | 11/2004 | Kanekiyo et al. | |
| 6,827,557 | B2 | 12/2004 | Kim | |
| 7,172,660 | B2 | 2/2007 | Song et al. | |
| 7,175,717 | B2 | 2/2007 | Song et al. | |
| 7,265,651 | B2 | 9/2007 | Brunner | |
| 7,532,099 | B2 | 5/2009 | Brunner | |
| RE41,269 | E | 4/2010 | Hundt et al. | |
| 2001/0015239 | A1 | 8/2001 | Kanekiyo et al. | |
| 2001/0031837 | A1 | 10/2001 | Perez et al. | |
| 2002/0062885 | A1 | 5/2002 | Li | |
| 2002/0124914 | A1* | 9/2002 | Kim | 148/403 |
| 2003/0156000 | A1 | 8/2003 | Brunner | |
| 2004/0045635 | A1 | 3/2004 | Bandyopadhyay et al. | |
| 2004/0079449 | A1 | 4/2004 | Kanekiyo et al. | |
| 2004/0089377 | A1 | 5/2004 | Deevi et al. | |
| 2004/0183643 | A1 | 9/2004 | Brunner | |
| 2005/0028889 | A1 | 2/2005 | Song et al. | |
| 2005/0034787 | A1 | 2/2005 | Song et al. | |
| 2005/0236071 | A1 | 10/2005 | Koshiba et al. | |
| 2006/0165985 | A1* | 7/2006 | Matsukawa et al. | 428/384 |
| 2007/0193657 | A1 | 8/2007 | Brunner | |
| 2008/0001702 | A1 | 1/2008 | Brunner | |
| 2009/0206975 | A1 | 8/2009 | Nuetzel et al. | |
| 2009/0320961 | A1 | 12/2009 | Brunner | |
| 2010/0265016 | A1 | 10/2010 | Petzold et al. | |

FOREIGN PATENT DOCUMENTS

| | | | |
|---|---|---|---|
| DE | 1564643 | | 1/1970 |
| DE | 2816173 | | 10/1979 |
| DE | 3422281 | A1 | 12/1984 |
| DE | 19608891 | A1 | 9/1997 |
| DE | 69714103 | T2 | 9/1997 |
| DE | 69810551 | T2 | 3/1999 |
| DE | 19860691 | A1 | 3/2000 |
| DE | 19846781 | | 4/2000 |
| DE | 198 37 630 | C1 | 5/2000 |
| DE | 19908374 | A1 | 9/2000 |
| DE | 199 42 939 | A1 | 3/2001 |
| DE | 100 64 024 | A1 | 6/2001 |
| DE | 10024824 | | 11/2001 |
| DE | 100 31 923 | A1 | 1/2002 |
| DE | 103 48 808 | B4 | 3/2005 |
| DE | 103 48 810 | A1 | 3/2005 |
| DE | 602 05 728 | T2 | 3/2006 |
| DE | 10 2006 008 283 | | 8/2007 |
| DE | 102006055088 | B4 | 6/2008 |
| EP | 0240755 | | 10/1987 |
| EP | 0 302 355 | A1 | 2/1989 |
| EP | 0 502 397 | A2 | 9/1992 |
| EP | 0435680 | B1 | 4/1995 |
| EP | 0455113 | B1 | 6/1997 |
| EP | 0 794 538 | A1 | 9/1997 |
| EP | 0794541 | A1 | 9/1997 |
| EP | 0899 753 | B1 | 3/1999 |
| EP | 0 936 638 | A2 | 8/1999 |
| EP | 1 371 434 | B1 | 12/2003 |
| JP | 53-055393 | | 5/1978 |
| JP | 56-112710 | | 9/1981 |
| JP | 57-039516 | | 3/1982 |
| JP | 57-122506 | A | 7/1982 |
| JP | 57-187357 | | 11/1982 |
| JP | 59148301 | A | 8/1984 |
| JP | 59177902 | | 10/1984 |
| JP | 59179729 | A | 10/1984 |
| JP | 60-260108 | | 12/1985 |
| JP | 61058450 | | 3/1986 |
| JP | 61-166902 | | 7/1986 |
| JP | 61-172709 | A | 8/1986 |
| JP | 62-226603 | | 10/1987 |
| JP | 62-232103 | | 10/1987 |
| JP | 63-21807 | | 1/1988 |
| JP | 63-115313 | A | 5/1988 |
| JP | 64-053404 | | 3/1989 |
| JP | 1-139702 | | 6/1989 |
| JP | 02-047812 | | 2/1990 |
| JP | 4-21436 | | 1/1992 |
| JP | 4-048005 | A | 2/1992 |
| JP | 41-65605 | | 6/1992 |
| JP | 05-283238 | | 10/1993 |
| JP | 05-299232 | | 11/1993 |
| JP | 53-04018 | | 11/1993 |
| JP | 06-224023 | | 8/1994 |
| JP | 82-55717 | | 10/1996 |
| JP | 83-18542 | A | 12/1996 |
| JP | 9-306715 | | 11/1997 |
| JP | 10-092623 | | 4/1998 |
| JP | 10-097913 | | 4/1998 |
| JP | 10-208923 | | 8/1998 |
| JP | 2000-182845 | | 6/2000 |
| JP | 2001-068324 | | 3/2001 |
| JP | 2001-196216 | | 7/2001 |
| JP | 2002-343626 | A | 11/2002 |
| JP | 2004-063798 | A | 7/2004 |
| JP | 2004-349585 | | 12/2004 |
| SU | 338550 | | 5/1972 |
| WO | WO 00/10755 | | 3/2000 |
| WO | WO 00/25326 | | 5/2000 |
| WO | WO 00/28556 | | 5/2000 |
| WO | WO 00/30132 | | 5/2000 |
| WO | WO 01/18828 | A1 | 3/2001 |
| WO | WO 01/91141 | A1 | 11/2001 |
| WO | WO 02/055749 | | 7/2002 |
| WO | WO 03/088281 | A1 | 10/2003 |

OTHER PUBLICATIONS

ASM Materials Engineering Dictionary, Edited by J.R. Davis, Davis & Associates, 1992, p. 2002.

Official Examination Communication dated Jun. 23, 2009 for Japanese Patent Publication No. JP 2000-565549 (expressed in the German language) and English Translation Certificate of Translation dated Jul. 28, 2009.

Kawamura, Yoshihito et al., "Fabrication of Nanocrystalline Fe86Zr7B6Cu1 Soft-Magnetic Compacts with High Saturation Magnetization", J. Applied Physics (ISSN 0021-8979), vol. 76, No. 9, p. 5545-5551, English Abstract.

G.H. Kim et al., "Magnetic properties of FeCuNbSiB nanocrystalline alloy powder cores using ball-milled powder", Journal of Applied Physics, vol. No. 10, Parts 2 and 3, May 15, 2003, pp. 7211-7213.

D. Nuetzel et al., "Nanocrystalline soft magnetic composite-cores with ideal orientation of the powder-flakes", Journal of Magnetism and Magnetic Materials 196-197, (1999), 327-329.

J. Patterson, et al., "Encapsulation of Sensors, Solenoids and Transformers With Engineering Thermoplastics," Proceedings of the Electrical Electronics Insulation Conference, Sep. 18, 1995, pp. 1-6.
Office Action dated Apr. 22, 2010 for German Patent Application No. 10 2009 038 730.7-24 and English Translation of the same.
Examination Report dated Feb. 26, 2003 for German Patent Publication No. 101 34 056.7-33 (English Translation and Certificate of Translation dated Nov. 23, 2009).
Official Action dated May 30, 2000 for German Patent Publication No. 100 24 824.1-33 (German Language).
Notification of Reasons for Refusal dated Jun. 29, 2010 for Japanese Patent Publication No. 2001-587447 and English Translation of the same.
Non-Final Office Action dated Jun. 11, 2009 for U.S. Appl. No. 11/663,271.
Non-Final Office Action dated Sep. 22, 2009 for U.S. Appl. No. 11/663,271.
Final Office Action dated Oct. 30, 2009 for U.S. Appl. No. 11/343,558.
Non-Final Office Action dated Apr. 1, 2010 for U.S. Appl. No. 11/343,558.
Final Office Action dated Oct. 15, 2010 for U.S. Appl. No. 11/343,558.
Non-Final Office Action dated Aug. 31, 2010 for U.S. Appl. No. 11/878,856.
Restriction Requirement dated Nov. 4, 2009 for U.S. Appl. No. 11/878,856.
Non-Final Office Action dated Mar. 22, 2010 for U.S. Appl. No. 11/878,856.
Restriction Requirement dated Sep. 22, 2010 for U.S. Appl. No. 12/219,615.
Restriction Requirement dated Apr. 26, 2010 for U.S. Appl. No. 12/486,528.
Non-Final Office Action dated Jul. 27, 2010 for U.S. Appl. No. 12/486,528.
Non-Final Office Action dated Sep. 29, 2008 for U.S. Appl. No. 11/343,558.
Non-Final Office Action dated Apr. 6, 2009 for U.S. Appl. No. 11/343,558.
G. Herzer et al., "Surface Crystallisation and Magnetic Properties in Amorphous Iron Rich Alloys," Journal of Magnetism and Magnetic Materials 62 (1986) 143-151, North-Holland, Amsterdam, Elsevier Science Publishers B.V.
Mazaleyrat et al., "Permeability of Soft Magnetic Composites From Flakes of Nanocrystalline Ribbon," IEEE Transactions of Magnetics, vol. 38, No. 5, Sep. 2002, pp. 3132-3134.

* cited by examiner

METHOD FOR THE PRODUCTION OF MAGNET CORES, MAGNET CORE AND INDUCTIVE COMPONENT WITH A MAGNET CORE

BACKGROUND

1. Field

Disclosed herein is a method for the production of magnetic powder composite cores pressed from a mix of alloy powder and binder. Also disclosed herein is a magnet core produced from a mix of alloy powder and binder and to an inductive component with a magnet core of this type.

2. Description of Related Art

Magnet cores, which are for example used in switched power supplies as storage chokes or as choke cores on the system input side, have to have a low permeability which must not be changed significantly either by a varying AC modulation or by a constant magnetic field superimposed on the AC modulation. For such applications, ferrite cores with an air gap have proved useful for the currently preferred operating frequencies in the range of some ten to a hundred kHz, while magnetic powder composite cores are used for higher-rated equipment.

Depending on operating frequency, the required storage energy and available space, various alloys can be considered for the production of these metal powder composite cores. In the simplest case, pure iron powders are used, but if superior magnetic properties are required, FeAlSi-based crystalline alloys (SENDUST) or even NiFe-based alloys are preferred. The most recent developments favour the use of rapidly solidified amorphous or nanocrystalline iron-based alloys. Amorphous FeSiB-based alloys, in particular, appear to offer advantages compared to classical crystalline alloys owing to their high saturation inductance, their low particle thickness due to manufacturing methods, and their high resistivity. Apart from the alloy itself, other factors such as a high packing density of the powder composite core are also highly relevant if the magnet core is to have a high storage energy or a high DC pre-loadability.

U.S. Pat. No. 7,172,660 B2 discloses powder composite cores produced from a rapidly solidified amorphous iron-based alloy, wherein a particularly high packing density of the magnet core is obtained by using a powder with a bimodal particle size distribution. The use of rapidly solidified amorphous alloys rather than crystalline alloys poses the problem that pressing at moderate temperatures does not result in a viscous flow of the powder particles, so that higher packing densities are difficult to obtain.

According to U.S. Pat. No. 5,509,975 A, high packing densities can also be obtained by pressing the powder to form a magnet core at temperatures slightly below the crystallisation temperature of the alloy used. However, the magnet cores produced in this way have a relatively high relative permeability and are therefore not suitable for applications where a maximum storage energy is required.

In addition, the relative permeability of these magnet cores changes significantly, in particular in the range of low modulations with constant magnetic fields. This is due to the marked platelet shape of the powder particles produced by the comminution of rapidly solidified strip. As a result, the powder particles are in the pressing process oriented with their face normal in the pressing direction, and the starting permeability becomes extremely high, particular at a high packing density, followed by a marked reduction in relative permeability as constant magnetic field modulation increases. This effect is described analytically in F. Mazaleyrat et al.: "Permeability of soft magnetic composites from flakes of nano crystalline ribbon", IEEE Transactions on Magnetics Vol. 38, 2002. This behaviour is undesirable in magnet cores used as storage chokes or as chokes for power factor correction (PFC chokes) in pulsed power supplies.

SUMMARY

There remains a need to solve the problem of specifying a magnet core, which in certain embodiments is desirably made from a powder of a rapidly solidified, amorphous iron-based alloy, which has both a high packing density and a highly linear permeability curve above a pre-magnetised constant field.

According to certain embodiments described herein, this problem is solved by the magnet cores, inductive components and methods of making these described herein.

In a particular embodiment is disclosed a magnet core comprising a composite of platelet-shaped powder particles with the thickness D and a binder, wherein the particles have an amorphous volume matrix. In this amorphous volume matrix are, on the surface of the particles, embedded areas with a crystalline structure which have a thickness d of $0.04*D \leqq d \leqq 0.25*D$, preferably $0.08*D \leqq d \leqq 0.2*D$, and cover a proportion x of $x \geqq 0.1$ of the surface of the particles. The symbol "*" denotes multiplication.

As a result, the generally amorphous particles have on their surfaces crystallised-on regions which do not necessarily form a continuous layer. As, described herein, this crystallisation can be obtained by a heat treatment of the magnet core after pressing, wherein the crystals grow from the surface of the particles into the amorphous volume matrix.

While not wishing to be based by any theory, it is believed that, the storage energy of a magnet core can be increased further by providing that the surfaces of the individual particles are partially crystallised by means of a special heat treatment as disclosed herein. The surface crystallisation involves a volume shrinkage in the region of the surface, which induces tensile stresses in the surface layer while inducing compressive stresses in the amorphous volume matrix of the particles. In combination with the high positive magnetostriction of FeSiB-based alloys, the compressive stresses in the volume matrix result in a magnetic preferred direction towards the face normal of the platelet-shaped particles. When the powder is pressed, the powder platelets align themselves under compacting pressure such that the platelet plane lies at right angles to the pressing direction and therefore parallel to the subsequent magnetisation direction of the magnet core. As a result, the anisotropy caused by the stress-induced magnetic preferred direction leads to a magnetic preferred direction of the magnet core at right angles to its magnetisation direction. The result is a linearisation of the modulation-dependent permeability curve of the magnet core which exceeds the influence of the geometrical shear of the magnetic circuit via the air gaps between the individual particles.

BRIEF DESCRIPTION OF DRAWINGS

Embodiments disclosed herein are explained in greater detail below with reference to the accompanying figures, which are not intended to be limiting.

Identical components are identified by the same reference numbers in all figures.

DETAILED DESCRIPTION OF SPECIFIC EMBODIMENTS

Figure 1:
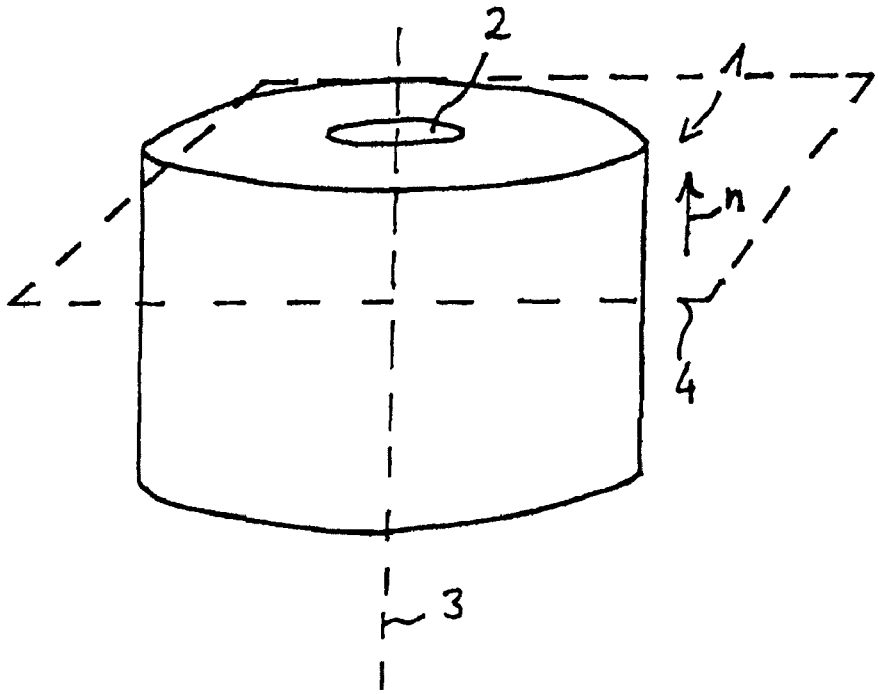
FIG. 1 is a schematic diagram of an embodiment of a magnet core described herein.

G. Herzer et al.: "Surface crystallisation in metallic glasses", Journal of Magnetism and Magnetic Materials 62 (1986), 143-151, suggests that, in soft magnetic strip, a crystallising-on of the strip surfaces can lead to a magnetic anisotropy of the material. However, it has surprisingly been found that this effect can also be used in the production of powder composite cores. While it has up to now been thought that the influence of geometrical shear via the air gap predominates in powder composite cores, it was established that the surface crystallisation of the platelet-shaped particles in the magnet cores as described herein results, against all expectations, in a further linearisation of the modulation-dependent permeability curve and thus to an unexpectedly improved suitability of the magnet cores for use as choke cores.

The term "platelet-shaped" in the present context describes particles which, for example as a result of being produced from strip or pieces of strip, essentially have two parallel main surfaces opposing each other, and which have a thickness significantly less than their length dimension in the plane of the main surfaces. The platelet-shaped particles advantageously have an aspect ratio of at least 2. In one embodiment, the thickness D of the particles is 10 μm≦D≦50 μm, preferably 20 μm≦D≦25 μm. In contrast, the average particle diameter L in the plane of the main surfaces is preferably approximately 90 μm.

In an advantageous embodiment, the alloy composition of the particles is $M_\alpha Y_\beta Z_\gamma$, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions: 60≦α≦85; 5≦β≦20; 0≦γ≦20. In particular embodiments, up to 10 atomic percent of the M component may be replaced by at least one element from the group including Ti, V, Cr, Mn, Cu, Zr, Nb, Mo, Ta and W and up to 10 atomic percent of the (Y+Z) component may be replaced by at least one element from the group including In, Sn, Sb and Pb.

In a particular embodiment, the platelet-shaped particles are advantageously provided with an electrically insulating coating on their surfaces to reduce eddy currents.

In a particular embodiment, as a binder for the powder composite core, at least one material from the group including polyimides, phenolic resins, silicone resins and aqueous solutions of alkali or alkaline earth silicates is used.

At a DC superposition permeability Δμ of 80% of the starting superposition permeability of $\Delta\mu_0$, a DC preloadability $B_0$ of $B_0 \geqq 0.24$ T can be obtained with embodiments of the magnet core described herein. The magnet core described herein therefore has excellent storage properties. As a result, it can be used to advantage in an inductive component. Owing to its magnetic properties, it is particularly suitable for use as a choke for power factor correction, as a storage choke, as a filter choke or as a smoothing choke.

In an embodiment of a method described herein for the production of a magnet core is included at least the following steps: A powder of amorphous, platelet-shaped particles with the thickness D is prepared and pressed with a binder to produce a magnet core. The magnet core is then heat treated for a duration $t_{anneal} \geqq 5$ h at a temperature $T_{anneal}$ of 390° C.≦$T_{anneal}$≦440° C. while areas with a crystalline structure embedded in the amorphous volume matrix are formed on the surface of the particles.

In an advantageous embodiment, heat treatment is continued until the areas with the crystalline structure have reached a thickness d of 0.04*D≦d≦0.25*D in the volume matrix and cover a proportion x of the surface of the particles wherein x≧0.1.

In particular embodiments, an alloy of the composition $M_\alpha Y_\beta Z_\gamma$ is advantageously used for the particles, wherein M is at least one element from the group including Fe, Ni and Co, wherein Y is at least one element from the group including B, C and P, wherein Z is at least one element from the group including Si, Al and Ge, and wherein α, β and γ are specified in atomic percent and meet the following conditions: 60≦α≦85; 5≦β≦20; 0≦γ≦20, wherein up to 10 atomic percent of the M component may be replaced by at least one element from the group including Ti, V, Cr, Mn, Cu, Zr, Nb, Mo, Ta and W and up to 10 atomic percent of the (Y+Z) component may be replaced by at least one element from the group including In, Sn, Sb and Pb.

In one embodiment of the method, the powder is prepared from amorphous particles in the following process steps: An amorphous strip with a thickness D of 10 μm≦D≦50 μm, preferably 20 μm≦D≦25, μm is produced in a rapid solidification process. The amorphous strip is then pre-embrittled by heat treatment at a temperature $T_{embrittle}$, followed by the comminution of the strip to produce platelet-shaped particles.

The temperature $T_{embrittle}$ is advantageously 100° C.≦$T_{embrittle}$≦400° C., preferably 200° C.≦$T_{embrittle}$≦400° C.

In one embodiment of the method, the amorphous strip is comminuted at a grinding temperature $T_{mill}$ of −196° C.≦$T_{mill}$≦100° C.

In one embodiment of the method, the particles are pickled in an aqueous or alcoholic solution and then dried before pressing in order to apply an electrically insulating coating.

In certain embodiments, as a binder, at least one material from the group including polyimides, phenolic resins, silicone resins and aqueous solutions of alkali or alkaline earth silicates, is advantageously used. The particles may be coated with the binder before pressing, or the binder may be mixed with the powder before pressing.

The powder is pressed in a suitable tool, for example in certain embodiments at a pressure between 1.5 and 3 GPa. After pressing, in certain embodiments the magnet core may be heat treated for stress relaxation for a duration $t_{relax}$ of approximately one hour at a temperature $T_{relax}$ of approximately 400° C., but this stress relaxation may alternatively be carried out during the heat treatment for surface crystallisation as described herein, so that there is no need for a separate heat treatment for stress relaxation. The heat treatments are advantageously carried out in an inert atmosphere.

In one embodiment of the method, processing additives such as lubricants are added to the particles and to the binder before pressing.

With the method described herein, magnet cores with a modification-dependent permeability curve which is more linear than previously known can be produced by relatively simple means.

The magnet core 1 according to FIG. 1 is a powder composite core with magnetic properties which permit its use, for example in switched power supplies, as storage chokes or as choke cores on the system input side. The cylindrical magnet core 1 is designed as a toroidal core with a central hole 2 and is symmetrical with respect to its longitudinal axis 3. While the powder is pressed to form the magnet core 1, a force is applied in the direction of the longitudinal axis 3. The plane 4 identified by the normal vector n marks the plane of the direction of magnetisation in the use of the magnet core 1.

Figure 2:
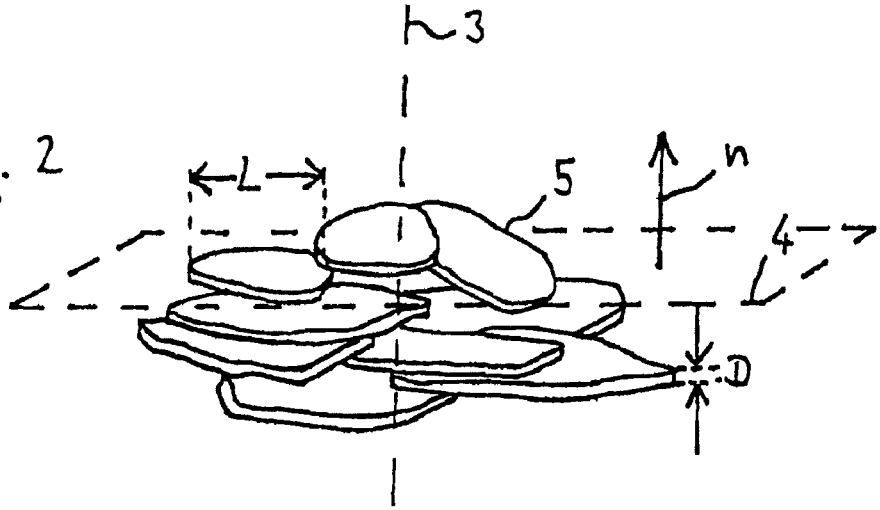
FIG. 2 is a schematic diagram showing the detailed structure of a magnet core made of platelet-shaped particles as described herein.

FIG. 2 schematically shows the platelet-shaped particles 5 of the magnet core 1 and their arrangement after pressing. The platelet-shaped particles 5 have two parallel main surfaces spaced from each other by the thickness D of the platelet-shaped particles 5. In certain embodiments, these main surfaces originally were the surfaces of a strip produced in a rapid solidification process, which was comminuted to produce the platelet-shaped particles 5. In a particular embodiment, the platelet-shaped particles 5 have an average platelet diameter of approximately 90 μm, which in the present context denotes the diameter L of the platelets in the plane of their main surfaces.

As a result of pressing with a pressure acting in the direction of the longitudinal axis 3, the platelet-shaped particles 5 are oriented substantially parallel to one another, as can be seen in FIG. 2, their main surfaces being parallel to the plane 4 of the magnetisation direction of the magnet core 1.

Figure 3:
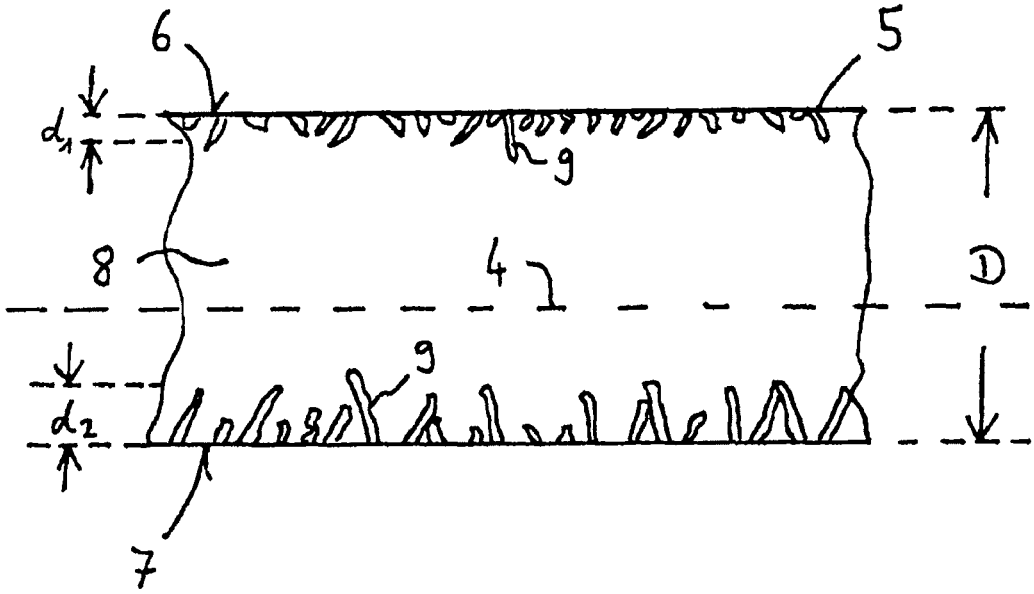
FIG. 3 is a schematic diagram showing a cross-section through a section of an individual platelet-shaped particle.

FIG. 3 is a schematic cross-section through a platelet-shaped particle 5. The platelet-shaped particle 5 has a first main surface 6, a second main surface 7 and a volume matrix 8 with an amorphous structure. Areas 9 with a crystalline structure are embedded within the amorphous volume matrix 8. The areas 9 with the crystalline structure are grown into the volume matrix 8 from the first main surface 6 and from the second main surface 7 by means of a heat treatment disclosed herein.

The areas 9 near the first main surface 6 have a thickness $d_1$, and the areas 7 near the second main surface 7 have a thickness $d_2$. In the particular embodiment shown in FIG. 3, $d_2$ is greater than $d_1$. This is due to the fact that the platelet-shaped particle 5 has been produced by comminuting a strip produced in a rapid solidification process, wherein the second main surface 7 corresponds to the side of the strip facing the rotating wheel. As a result, the material of the strip was subjected to different temperature gradients on its two main surfaces. This relationship is described in G. Herzer et al.: "Surface crystallisation in metallic glasses", Journal of Magnetism and Magnetic Materials 62 (1986), 143-151.

The relation $d_2 \neq d_1$ does not necessarily apply to every embodiment of the magnet core 1 described herein. The essential aspect is that the crystalline areas 9 have an average thickness d (which could be the mean value from $d_2$ and $d_1$ in the described embodiment) of at least 5% and at most a quarter of the thickness D of the platelet-shaped particle 5. The crystalline areas 9 cover a proportion x of at least one tenth of the surfaces of the particle 5, i.e. essentially one tenth of the first main surface 6 and the second main surface 7.

Figure 4:
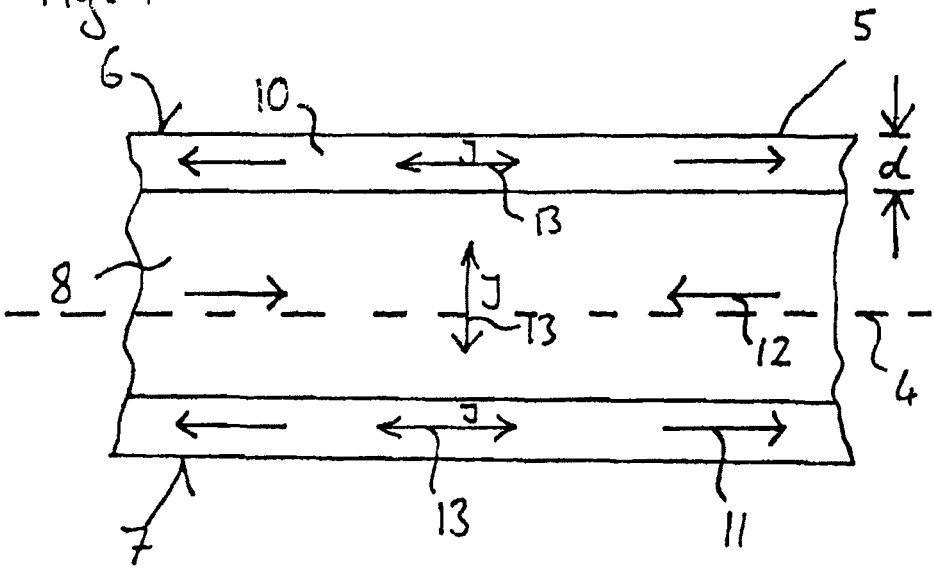
FIG. 4 is a schematic diagram showing a cross-section through a section of an individual platelet-shaped particle.

In this case, it is believed that the volume shrinkage at the surfaces of the platelet-shaped particles 5, which accompanies crystallisation, causes tensile stresses near the surface and compressive stresses in the volume matrix 8 of the platelet-shaped particles 5. This is illustrated schematically in FIG. 4. The platelet-shaped particle 5 can be divided into the near-surface crystallisation zones 10 with the thickness d and the amorphous volume matrix 8. Volume shrinkage and thus tensile stresses occur in the crystallisation zones 10, where the tensile stresses are indicated by arrows 11. The volume matrix, on the other hand, is subject to compressive stresses indicated by arrows 12.

According to a theory explained by Ok et al. in Physical Review Letters B, 23 (1981) 2257, this results in the crystallisation zones 10 having a magnetic anisotropy J parallel to the plane 4 of the subsequent magnetisation direction and in the volume matrix 8 in a magnetic anisotropy J at right angles to the subsequent magnetisation direction as indicated by arrows 13.

As the volume of the amorphous volume matrix 8 is significantly larger than that of the crystalline areas 9 as a rule, the influence of the anisotropy J at right angles to the plane 4 of the subsequent magnetisation direction predominates, and the parallel orientation of the platelet-shaped particles 5 during the pressing process results in a magnetic preferred direction at right angles to the magnetisation direction of the magnet core 1 and thus in a linearisation of the modulation-dependent permeability curve of the magnet core which exceeds the influence of the geometrical shear of the magnetic circuit.

Figure 5:
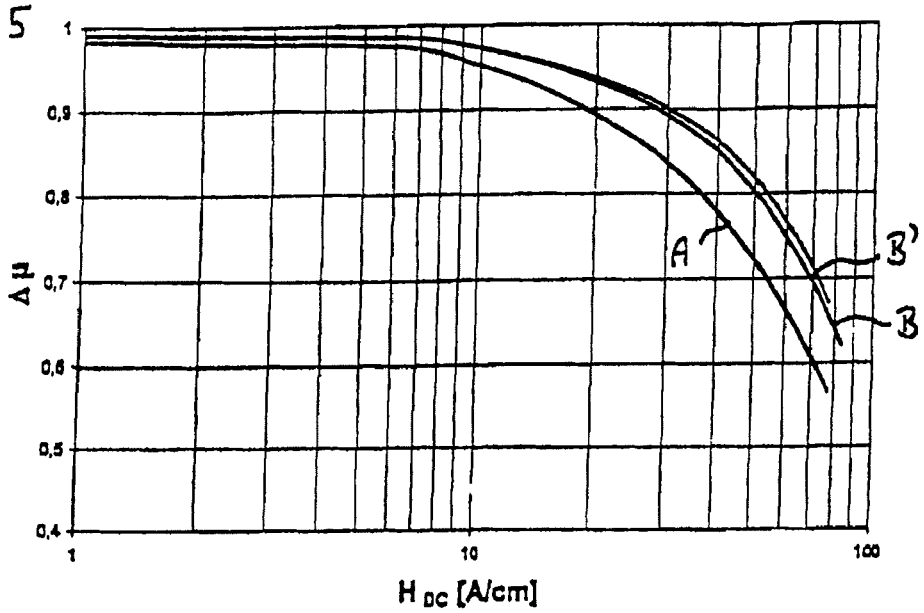
FIG. 5 is a graph showing the DC superposition permeability curve of magnet cores according to an embodiment described herein.
Figure 6:
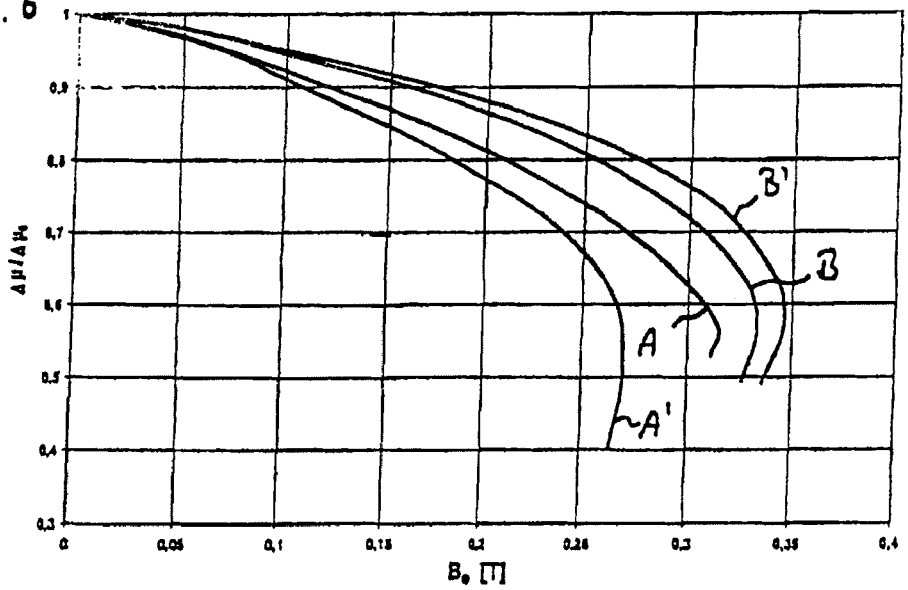
FIG. 6 is a graph showing the DC preloadability curve $B_0$ for magnet cores according to FIG. 5.

FIGS. 5 and 6 are graphs that show the results of measurements of magnetic variables in one embodiment of magnet cores produced as described herein.

For this purpose, an amorphous strip with a thickness of 23 μm is produced in a rapid solidification process from an alloy of the composition $Fe_{Rest}Si_9B_{12}$. To reduce its ductility and therefore to make it easier to comminute, this strip is subjected to a heat treatment lasting between half an hour and four hours in an inert atmosphere at a temperature between 250° C. and 350° C. The duration and the temperature of the heat treatment were determined by the required degree of embrittlement; typical values are a temperature of 320° C. and a duration of one hour.

Following the heat treatment for embrittlement, the strip is comminuted using a suitable mill such as an impact mill or disc mill to produce a powder of platelet-shaped particles with an average grain size of 90 μm. The platelet-shaped particles are then provided with an electrically insulating oxalic or phosphate surface coating and coated with a heat-resistant binder selected from the group including polyimides, phenolic resins, silicone resins and aqueous solutions of alkali or alkaline earth silicates. The thus coated platelet-shaped particles are finally mixed with a high-pressure lubricant, which may for example be based on metallic soaps or suitable solid lubricants such as $MoS_2$ or BN.

The mixture prepared in this way is pressed in a pressing tool at pressures between 1.5 and 3 GPs to form a magnet core. The pressing process is followed by a final heat treatment for stress relaxation and for the formation of crystalline areas on the surface of the platelet-shaped particles, the heat treatment being performed in an inert atmosphere at a temperature between 390° C. and 440° C. for a duration of 5 to 64 hours.

FIG. 5 shows the effect of surface crystallisation of the platelet-shaped particles on the DC superposition permeability curve Δμ. The magnet core of curve A was produced in the manner described above, but the heat treatment for the surface crystallisation of the platelet-shaped articles was omitted and the magnet core was only subjected to one hour's heat treatment at 440° C. for stress relaxation. This magnet core A therefore corresponds to magnet cores produced by prior art techniques.

The magnet core of curve B was produced in accordance with the method described herein and heat-treated for 8 hours at 440° C. This magnet core therefore has crystallised areas on the particle surface. The magnet core of curve B' was likewise produced in accordance with the method described herein and heat-treated for 24 hours at 410° C. This longer heat treatment of the magnet core B' at a slightly lower temperature results in the compaction of the crystalline surface layer, i.e. the proportion x increases without any significant increase in the thickness d of the crystalline areas. As FIG. 5 shows, this leads to a further linearisation of the DC superposition permeability curve $\Delta\mu$. All of the magnet cores tested have a starting superposition permeability $\Delta\mu_0$ of approximately 60.

According to R Boll, "Weichmagnetische Werkstoffe" (Soft-magnetic Materials) ($4^{th}$ edition 1990), pages 114-115, the DC preloadability $B_0$ defined as $B_0=\Delta\mu*\mu_0*H_{DC}$, wherein $\Delta\mu$ is the DC superposition permeability of the magnet core, $\mu_0$ is the magnetic field constant and $H_{DC}$ is the DC field modification, is a suitable measure for the obtainable storage energy. The DC preloadability $B_0$ is particularly suitable for the direct comparison of the suitability of various materials for use in choke cores.

FIG. 6 shows the increase of the DC preloadability $B_0$ for given relative DC superposition permeability values of the magnet cores which can be achieved with the production method according to the invention. For easier comparison, the curve A' was added for a magnet core made of a known FeAlSi alloy (Sendust). As FIG. 6 shows, the magnet cores according to the invention can achieve a DC preloadability $B_0$ of $B_0 \geqq 0.24$ T at a DC superposition permeability $\Delta\mu$ of 80% of the starting super-position permeability of $\Delta\mu_0$.

The invention having been described with reference to certain specific embodiments and examples, it will be seen that these do not limit the scope of the appended claims.

The invention claimed is:

1. A magnet core comprising a composite of:

(a) platelet-shaped particles of a magnetic alloy, each comprising an amorphous volume matrix and two opposing main surfaces which are separated by a thickness D, wherein extending into the amorphous volume matrix from at least one of the surfaces are embedded areas having a crystalline structure, which embedded areas extend into the amorphous volume matrix a thickness d, such that $0.04*D \leqq d \leqq 0.25*D$ and which embedded areas cover a proportion x of the surface of the platelet-shaped particles such that $x \geqq 0.1$; and (b) a binder.

2. The magnet core according to claim 1, wherein the thickness d is such that $0.08*D \leqq d \leqq 0.2*D$.

3. The magnet core according to claim 1, wherein the platelet-shaped particles of a magnetic alloy comprise the alloy composition $M_\alpha Y_\beta Z_\gamma$, wherein M is at least one element selected from the group consisting of Fe, Ni and Co, wherein Y is at least one element selected from the group consisting of B, C and P, wherein Z is at least one element selected from the group consisting of Si, Al and Ge, and wherein $\alpha$, $\beta$ and $\gamma$ are specified in atomic percent and meet the following conditions: $60 \leqq \alpha \leqq 85$; $5 \leqq \beta \leqq 20$; $0 \leqq \alpha \leqq 20$, wherein up to 10 atomic percent of the M component may be replaced by at least one element selected from the group consisting of Ti, V, Cr, Mn, Cu, Zr, Nb, Mo, Ta, and W, and wherein up to 10 atomic percent of the (Y+Z) component may be replaced by at least one element selected from the group consisting of In, Sn, Sb and Pb.

4. The magnet core according to claim 1, wherein the magnet core has a DC preloadability $B_0$ of $B_0 \geqq 0.24$ T at a DC superposition permeability $\Delta\mu$ of 80% of the starting superposition permeability of $\Delta\mu_0$.

5. The magnet core according to claim 1, wherein the platelet-shaped particles have an aspect ratio of at least 2.

6. The magnet core according to claim 1, wherein the thickness D of the platelet-shaped particles is such that $10\ \mu m \leqq D \leqq 50\ \mu m$.

7. The magnet core according to claim 6, wherein the thickness D of the platelet-shaped particles is such that $20\ \mu m \leqq D \leqq 25\ \mu m$.

8. The magnet core according to claim 1, wherein the platelet-shaped particles have an average particle diameter L of approximately 90 μm in a plane parallel to the main surfaces.

9. The magnet core according to claim 1, wherein the platelet-shaped particles further comprise an electrically insulating coating on at least the main surfaces.

10. The magnet core according to claim 1, wherein the binder comprises at least one material selected from the group consisting of polyimides, phenolic resins, silicone resins and aqueous solutions of alkali or alkaline earth silicates.

11. An inductive component comprising a magnet core according to claim 1.

12. The inductive component according to claim 11, wherein the inductive component is a choke for power factor correction.

13. The inductive component according to claim 11, wherein the inductive component is a storage choke.

14. The inductive component according to claim 11, wherein the inductive component is a filter choke.

15. The inductive component according to claim 11, wherein the inductive component is a smoothing choke.

* * * * *